United States Patent [19]

Salzsauler

[11] Patent Number: 4,938,008

[45] Date of Patent: Jul. 3, 1990

[54] PALLET WRAPPING APPARATUS

[76] Inventor: Roy Salzsauler, P.O. Box 271, Georgetown, Ontario, Canada, L7G 4Y5

[21] Appl. No.: 292,266

[22] Filed: Dec. 30, 1988

Related U.S. Application Data

[63] Continuation of Ser. No. 072,146, Jul. 10, 1987, abandoned.

[51] Int. Cl.[5] ..... B65B 13/04

[52] U.S. Cl. ..... 53/556; 53/588

[58] Field of Search ..... 53/556, 587, 588, 210

[56] References Cited

U.S. PATENT DOCUMENTS

| | | | |
|---|---|---|---|
| 4,067,174 | 1/1978 | Goldstein | 53/588 X |
| 4,109,445 | 8/1978 | Shulman | 53/588 X |
| 4,248,031 | 2/1981 | Del Pozo, Jr. | 53/587 X |
| 4,282,700 | 8/1981 | Goldstein | 53/588 X |
| 4,722,170 | 2/1988 | Ball | 53/556 |
| 4,747,252 | 5/1988 | Kapke | 53/556 X |

FOREIGN PATENT DOCUMENTS

| | | | |
|---|---|---|---|
| 220712 | 5/1987 | European Pat. Off. | 53/556 |

OTHER PUBLICATIONS

"Cobra Pallet Wrapper", Mueller Packaging, Inc., March 1, 1985.

*Primary Examiner*—John Sipos

[57] ABSTRACT

In a pallet wrapping apparatus for wrapping pallet loads or the like with a membrane comprising; a support beam adapted for generally horizontal securement to a vertical structure above the pallet load, an arm one end of which is rotatably connected to the beam in the region remote from the structure, dispensing structure depending from the other end of the arm for dispensing the membrane, and a drive mechanism adapted to rotate the arm about the load and dispense the membrane from the dispensing structure so as to wrap the membrane about the pallet load.

12 Claims, 3 Drawing Sheets

PALLET WRAPPING APPARATUS

This is a continuation of application Ser. No. 07/072,146, filed Jul. 10, 1987, now abandoned.

FIELD OF INVENTION

This invention relates to an apparatus for wrapping pallet loads with a membrane adapted to contain the load during shipping and transport. More particularly, it relates to a pallet wrapping apparatus adapted to wrap pallet loads while the pallet remains stationary.

BACKGROUND TO INVENTION

The shipment of pallet loads of goods constitutes a substantial part of commercial traffic. Frequently the pallet loads may comprise articles that do not stack in sufficiently stable configurations to permit stability during shipping. Often it is desirable to ship pallet loads of goods which are dimensionally different in size and shape from load to load depending on the purchase orders being filled. In these situations and numerous others, it has been found desirable to have some means for wrapping the pallet load with a membrane such as plastic film or fabric or plastic netting that will tightly fit about the articles in the load and contain them during the bumps and knocks of commercial transport.

Perhaps the most common of these methods comprises turning the pallet load while leading the ribbon of film onto the load and permitting it to wrap the load as the pallet turns. In some methods, the wrapping may be followed by heating of the membrane to shrink fit it about the goods, in other cases, an elastic membrane is wrapped under tension to obtain a tight fit. Examples of the prior art are found in U.S. Pat. No. 3,867,806, entitled "Process of Making a Stretch-Wrap Package" which issued to Lantech, Inc. on Feb. 25, 1975; U.S. Pat. No. 3,896,288 entitled "Method of Heat-Shrink Wrapping Goods" which issued to Martin J. Tulkoff on July 22, 1975.

The apparatus which has been developed and sold to implement this method of pallet wrapping suffers the common deficiency that the pallet load must be rotated during wrapping. Accordingly, means must be provided to get the pallet load onto and off of a rotatable table and means must be provided to rotate and support the table under a variety of loads and conditions. It is perceived by the present inventor that this deficiency leads to increased costs of fabrication, installation and operation for such apparatus.

Other apparatus have been developed which rotate both the pallet load and the source of the wrapping membrane, for example that disclosed in C.P. 1,114,279 entitled "Tension Wrap Packaging Machine" which issued to Stretch-Wrap Inc. on Dec. 15, 1981. However, this apparatus is again complicated and would seem to suffer all of the deficiencies mentioned above. See also in this regard, U.S. Pat. No. 4,079,565 entitled "Stretch-Wrapped Package, Process and Apparatus" which issued to Lantech, Inc. on Mar. 21, 1978.

Other apparatus is disclosed in U.S. Pat. No. 3,793,798 entitled "Shrink Palletized Process and Apparatus" which issued to Lantech, Inc on Feb. 26, 1974, which teaches a dispenser mounted on an arm which rotates over a palletized load to wrap the load with plastic membrane. After wrapping, the palletized load is carried on into an oven for heat shrinkage. The apparatus described in this patent uses a roll of membrane material having sufficient width to wrap a package of goods on a pallet with a single turn of the membrane roll about the palletized load. This apparatus lacks versatility for wrapping loads having a variety of heights. Accommodation is made for loads of differing heights by having apparatus which will permit the insertion of different size rolls on the dispenser. However, this apparatus suffers the deficiency that where each load is of a different height it would require constant changing of the rolls in order to complete coverage without wastage of material.

OBJECT OF INVENTION

It is an object of this invention to provide a novel and simple apparatus of economical construction, installation and operation which is capable of wrapping pallet loads of goods in which a dispenser of stretch-wrap plastic film is turned about a palletized load while moving up and down with respect to such load in order to obtain a complete cover without wastage of film.

FEATURES OF INVENTION

It is an aspect of this invention to provide a pallet wrapping apparatus for wrapping pallet loads or the like with a member which comprises, a support beam adapted for generally horizontal securement to a vertical structure above the pallet load, an arm one end of which is rotatably connected to the beam in the region remote from the structure, dispensing structure depending from the other end of the arm for dispensing the membrane, and drive mechanism adapted to rotate the arm about the load and dispense the membrane from the dispensing means so as to wrap the membrane about the pallet load.

It is another aspect of this invention to provide a pallet wrapping apparatus for wrapping pallet loads or the like with a stretchable membrane comprising, a support beam which is disposed adjacent the pallet load, an arm one end of which is rotatably connected to the beam, dispensing structure extending outwardly from the other end of the arm for dispensing the stretchable membrane, drive structure adapted to rotate the arm about the load so as to dispense the stretchable membrane from the dispensing structure and wrap the stretchable membrane about the pallet load and means associated with the dispensing structure so as to displace the dispensing structure between a first and second limit during rotation of the arm about the pallet load so as to wrap the stretchable membrane about the pallet load between the first and second limits.

DESCRIPTION OF THE DRAWINGS

These and other objects and features are illustrated and described in the following specification to be read in conjunction with the sheets of drawings in which.

DESCRIPTION OF THE INVENTION

In the figures like numerals represent the like elements.

Figure 1:
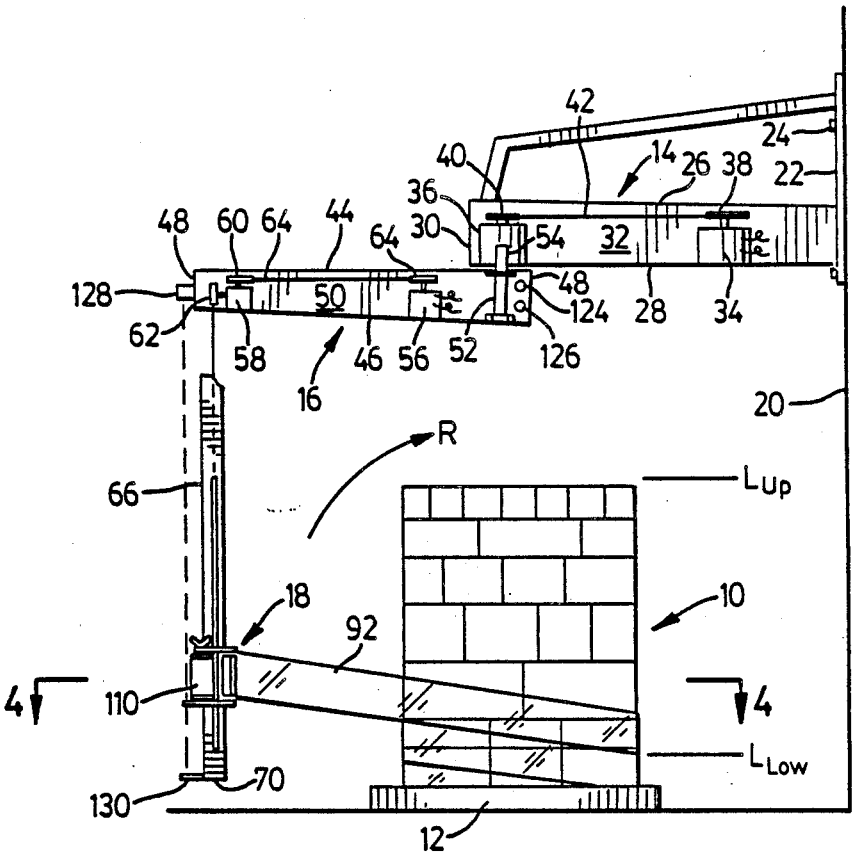
FIG. 1 is a cross-sectional view of the pallet wrapping apparatus.
Figure 4:
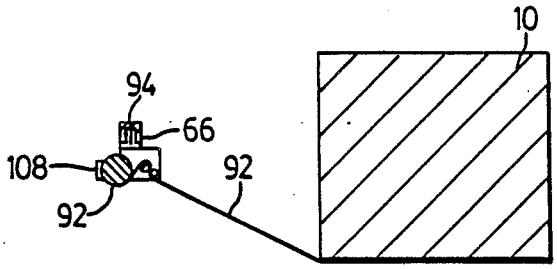
FIG. 4 is a cross-sectional view taken along the line 4—4 of FIG. 1.

In FIG. 1, a palletized load 10 is shown supported on a pallet 12 before the apparatus of this invention.

The apparatus comprises a support beam 14, rotatable arm 16, and dispensing structure 18.

The support beam 14 is bolted to a wall 20 by means of a plate 22 and bolts 24.

Although the support beam 14 is illustrated as being wall mounted it may also be supported by a vertical structure such as a vertical I beam (not shown) which is attached to a "C-Shaped" movable structure overlying a floor. In such arrangement the pallet load would be driven onto the "C-Shaped" structure and the pallet load would contribute to the stability of the structure during the wrapping procedure It is preferred however that the support beam 14 be cantilevered or bolted to a vertical wall as shown in FIG. 1 as this construction uses the least floor space while providing a sufficiently rigid structure to support the forces generated within the apparatus during wrapping.

The support beam 14 of the preferred embodiment is manufactured from sheet steel having a top wall 26, bottom wall 28, end wall 30 and two opposite side walls 32 so as to define an enclosure or hollow structure between said walls 26, 28, 30 and 32.

The support beam 14 houses a motor 34 and a gear box arrangement 36. The motor 34 and gear box 36 each present a pulley and shaft assembly 38 and 40 respectively which are connected together by means of an endless belt 42.

The apparatus also presents a rotatable arm 16 one end of which is rotatably connected to the beam 14 in the region remote from the wall 20. The arm 16 is also manufactured from sheet steel having a top wall 44, bottom wall 46, end walls 48 and opposite side walls 50 so as to define a rectangular enclosure therein.

More particularly the arm 16 presents a shaft 52. One end of the shaft 52 is fixedly secured to the arm 16 and the other end of the shaft 52 is rotatably connected to the support beam 14. The gear box 36 includes an aperture 54 which fixedly releasably secures the other end of the shaft 52.

Energization of the motor 34 causes the belt 42 to activate gears (not shown) within gear box 36 which in turn rotates shaft 52 fixedly secured to the arm 16 thereby causing the arm 16 to rotate above and about the pallet load 10.

Arm 16 contains motor 56 and gear box 58. Gear box 58 presents a rotatable shaft and pulley arrangement 60 and a sprocket and shaft arrangement 62 which are perpendicularly disposed relative one another and connected by gears (not shown) so as to change the horizontal rotational motion within the arm 16 to a vertical motion to the dispensing structure 18 in a manner to be more fully described herein.

Motor 56 also presents a pulley and shaft arrangement 64 which is connected to the pulley and shaft arrangement 60 of gear box 58 by means of an endless belt 64.

Figure 2:
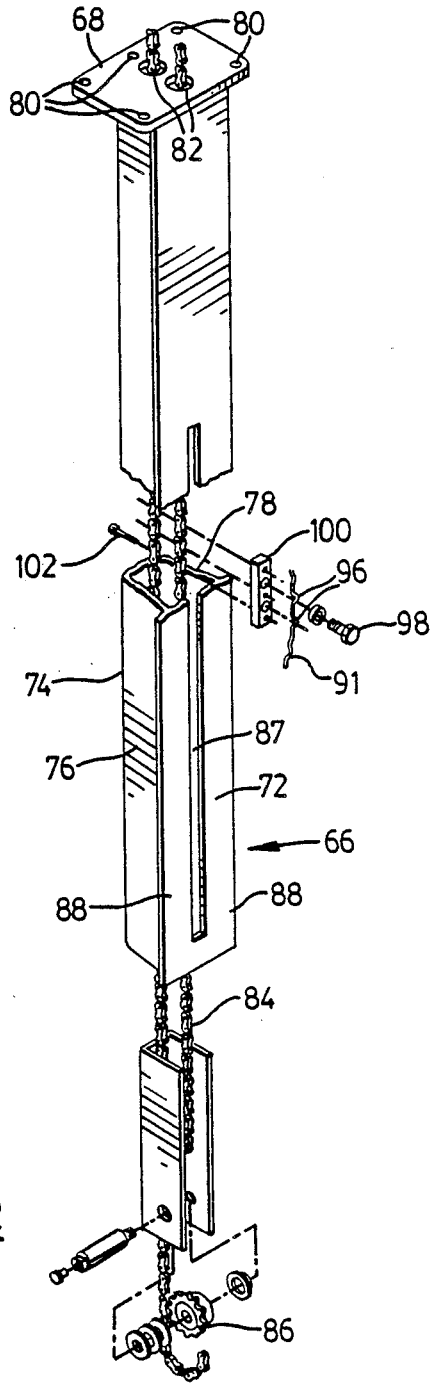
FIG. 2 is a partial exploded perspective view of the depending leg of the pallet wrapping apparatus.
Figure 3:
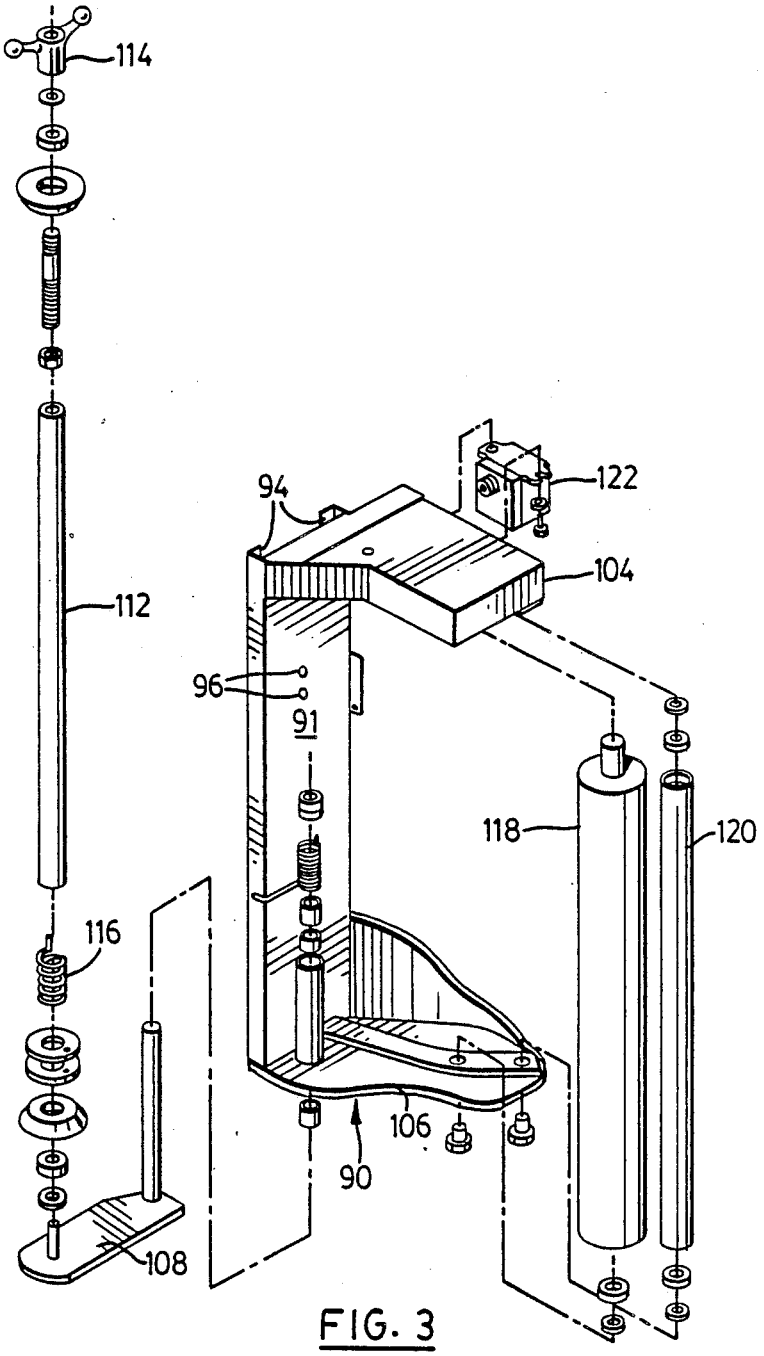
FIG. 3 is a partial exploded perspective view of the carriage.

The other end of the arm 16 which is remote from shaft 52 presents a depending leg 66 which is best illustrated in FIG. 2. Leg 66 is also manufactured from sheet steel having a top wall 68, bottom wall 70, front wall 72, back wall 74, and side walls 76 and 78, so as to define a rectangular enclosure therein. Top wall 68 includes a series of holes 80 which are adapted to receive bolts (not shown) so as to fixedly secure the leg 66 to the arm 16.

Top wall 68 also presents two apertures 82 for receiving the return links of an endless link chain 84.

Leg 66 presents a sprocket 86 in the region remote from the arm 16. Sprockets 62 and 86 are connected together by the endless chain link 84.

Energization of motor 56 rotates pulley and shaft arrangement 64 which transfers such rotational motion to the pulley and shaft arrangement 60 of gear box 58 by means of the endless belt 64. The rotational motion of the pulley and shaft arrangement 60 is transferred to the sprocket 62 thereby causing the endless chain link to rotate about the sprockets 62 and 86 so as to displace the chain 84 which is located within leg 66 in a vertical direction.

As best illustrated in FIG. 2, front wall 72 presents a vertical slot 87 and two protruding flange portions 88 along the vertical length thereof. The flange portions 88 are adapted to be received by a vertically displacable carriage 90 for dispensing a stretchable membrane 92 such as plastic film or the like about the pallet load 10 in a manner to be more fully particularized herein.

Carriage 90 presents a vertical wall 91 which includes a channel portion 94 for receiving flange portions 88 of leg 66 and to slide there along in a vertical direction.

The vertical wall 91 includes holes 96 which received bolts 98 that are adapted to protrude slot 87 for securement to the chain 8 4 by means of securing element 100 and securing bolts 102 as best illustrated in FIG. 2.

Therefore since the carriage 90 is secured to the chain link 84, movement or displacement of the chain 84 will cause movement or displacement of the carriage 90. More particularly as described above, energization of motor 56 will cause the rotation of chain link 84 about sprocket 62 and 86 in a vertical direction thereby causing a vertical displacement of carriage 90. Furthermore motor 56 may be energized so as to cause the carriage 90 to be displaced vertically upwardly or vertically downwardly depending on the polarity of the electrical energy applied to the motor 56 in a manner well known to those persons skilled in the art.

Carriage 90 also presents top plate 104 and bottom plate 106. Bottom plate 106 is adapted to receive membrane roll dispenser plate 108 which supports a roll of plastic film 110. The roll 110 fits axially over roll shaft 112 and is secured thereto by a wing nut 114.

The roll shaft 110 is also equipped with a tensioning spring 116 which in combination with the wing nut 114 provides a means for the operator to adjust the tensioning of the wrap of plastic membrane 92 during rotation. By tighting wing nut 114, greater pressure is exerted to the opposite ends of roll 110 thereby imparting an increased tensioning or pressure to the roll 102.

Increased tensioning will allow the operator of the apparatus to more tightly wind the membrane 92 about the pallet load 10 during rotation. If a stretchable membrane such as plastic film 92 is utilized in the roll 110, the increased tensioning will cause the stretchable membrane to stretch which assists in securing the pallet load.

Carriage 90 also is equipped with guide rolls 118 and 120 which assist in guiding the membrane 92 about the pallet load 10.

The operation of the pallet wrapping apparatus will now be described.

A pallet load 10 is positioned below the apparatus approximately centred below shaft 52 by means of a tow truck. The end piece of a membrane 92 is then secured to a portion of the pallet load 10.

Motor 34 is then energized by suitable electrical circuitry (not shown) which drives the arm 16 by rotating arm 16 about shaft 52. This causes the arm 16 to rotate above and about the pallet load 10.

It will be apparent that the horizontal length of the arm 16 will be such that arm 16 will clear the horizontal distance between shaft 52 and wall 20.

As the arm 16 rotates about load 10 the carriage 90 dispenses the membrane 92 about the pallet load so as to wrap the membrane 92 about the pallet load 10.

Motor 56 may also be energized by suitable electrical circuitry (not shown) so as to vertically displace the carriage 90 relative the pallet load during rotation of the arm 16 about the pallet load 10 so as to wrap the membrane 92 vertically about pallet load 10.

In the preferred embodiment the carriage 90 is in a first or lower most limit $^{L}$Low when the apparatus is de-energized or when commencing operation of the apparatus. Upon rotation of the arm 16 about pallet load 10 the motor 56 is energized which the causes the chain 84 to vertically displace or lift dispensing carriage 90 thereby causing the membrane 92 to be helically wrapped about the pallet load during rotation of the arm 16 about pallet load 10.

The upper or second limit $^{L}$Up of vertical displacement of carriage 90 is defined by the upper most portion of slot 87. However the upper most limit of displacement of carriage 90 may be controlled by controlling the energization of motor 56.

The carriage 90 may also be equipped with a light emitting device 122 with suitable electrical circuitry (not shown) which emits a beam of light toward pallet load 10 during vertical displacement of carriage 90 and is reflected back towards the device 122 by the pallet 10. However once the vertical displacement of carriage 90 exceeds the height of pallet load 10, the beam of light is no longer reflected back towards the device 122 by the pallet load 10 and the vertical displacement of carriage 10 is automatically stopped.

The motor 56 may also be equipped with suitable circuitry (not shown) so as to cause the carriage 90 to displace downwardly from its upper position $^{L}$Up to its lower position $^{L}$Low.

Furthermore the apparatus is also equipped with programable knobs 124 and 126 which are connected to suitable circuitry (not shown) which permits the operator to program the apparatus so as to select the number of wraps of membrane 92 about the pallet load 10 in the lower limit $^{L}$Low and to select the number of wraps of membrane 92 about the pallet load 10 in the upper limit $^{L}$Up.

Also the rotational leading portion of leg 66 and arm 16 may be equipped with light emitting and reflective devices 128 and 130 respectively. So long as the beam of emitted and reflected light is not interrupted, the arm 16 will continue to rotate about pallet loads 10 upon energization of motor 34. However if something obstructs the path of Rotation of the apparatus, the beam of light is broken, motor 34 is de-energized, and the rotation of arm 16 is automatically stopped. This serves as a mechanism to protect the apparatus from being accidentally damaged.

The speed of rotation of arm 16 and vertical displacement of carriage 90 may be controlled by suitable electrical circuitry.

By utilizing the pallet wrapping apparatus as disclosed herein, the operator may wrap pallet loads of different heights and sizes by utilizing the same size of roll of membrane 92.

Although the preferred embodiment as well as the operation and use has been specifically described in relation to the drawings, it should be understood that variations in the preferred embodiment could be easily achieved by a skilled man in the trade without departing from spirit of the invention. Accordingly the invention should not be understood as to be limited to the exact form revealed by the drawings. And in particular the gear box 58 and endless link chain 84 could be substituted by a long threaded lead screw within leg 66 which would be directly connected to pulley 60, and the carriage 90 connected to the lead screw by means of threaded collars or the like.

The embodiments of the invention in which an exclusive property or privilege is claimed are defined as follows:

1. Pallet wrapping apparatus for wrapping pallet loads or the like with a membrane comprising:

(a) support means adapted to be solely supported at one end thereof for general horizontal securement to a vertical wall above said pallet load, said support means defining an enclosure for housing drive means interiorally of said support means;

(b) arm means one end of which is rotatably connected to another end of said support means in the region remote from such structure, said arm means defining an enclosure for housing second drive means interiorally of said arm means;

(c) hollow leg means depending from another end of said arm means for and solely supported by said arm means;

(d) endless chain link means disposed interiorally of said hollow leg means, said endless chain link means engageable with said second drive means;

(e) carriage means carried by said leg means, said carriage means connected to said endless chain link means;

(f) said first drive means adapted to rotate said arm means about said load and dispense said membrane from said carriage means so as to wrap said membrane about said pallet load;

(g) said second drive means adapted to displace said endless chain link means whereby said carriage means is displaced along said hollow leg means between an upper and lower limit during rotation of said arm means about said pallet load so as to wrap said membrane about said pallet load between said upper and lower limits.

2. Pallet wrapping apparatus as claimed in claim 1 including means associated with said dispensing means for vertically displacing said dispensing means relative said pallet load during rotation of said arm means about said pallet load so as to wrap said membrane vertically about said pallet load.

3. Pallet wrapping apparatus as claimed in claim 2 including means to limit the vertical displacement of said carriage means relative said pallet load between an upper limit and a lower limit during rotation of said arm means about said pallet load so as to wrap said membrane about said pallet load between said upper and lower limits.

4. Pallet wrapping apparatus as claimed in claim 3 wherein said membrane is helically wrapped about said pallet load between upper and lower limits.

5. Pallet wrapping apparatus as claimed in claim 4 wherein said second drive means is adapted to vertically reciprocally displace said endless chain link means and said carriage means relative said pallet load between said upper and lower limits during rotation of said arm means about said pallet load so as to wrap said membrane about said pallet load between said upper and lower limits.

6. Pallet wrapping apparatus as claimed in claim 4 including programable means to select the number of wraps of membrane about said pallet load in said lower limit and to select the number of wraps of membrane about said pallet load in said upper limit.

7. Pallet wrapping apparatus as claimed in claim 6 wherein said carriage means includes adjustable tensioning means so as to permit the selected tensioning of said membrane during wrapping of said membrane about said pallet load.

8. Pallet wrapping apparatus as claimed in claim 7 including automatic stop means associated with said arm means and said carriage means so as to automatically stop the rotation of said arm means about said pallet load when an object obstructs the path of rotation of said arm means about said pallet load.

9. Pallet wrapping apparatus as claimed in claim 8 wherein said dispensing means includes height detecting means so as to detect the height of said pallet load.

10. Pallet wrapping apparatus for wrapping loads or the like with a stretchable membrane comprising:

(a) support means adapted to be solely supported at one end thereof above said pallet load, said support means defining an enclosure for housing first drive means interiorally of said support means;

(b) arm means one end of which is rotatably connected to another end of said support means, said arm means defining an enclosure for housing second drive means interiorally of said arm means;

(c) hollow leg means extending outwardly from another end of said arm means and solely supported by said arm means;

(d) endless chain link means disposed interiorally of said hollow leg means, said endless chain link means engageable with said second drive means;

(e) carriage means carried by said leg means, said carriage means connected to said endless chain link means;

(f) said first drive means adapted to rotate said arm means about said load so as to dispense said stretchable membrane from said carriage means and wrap said stretchable membrane about said pallet load;

(g) said second drive means adapted to displace said endless chain link means whereby said carriage means is displaced along said hollow leg means between a first and second limit during rotation of said arm means about said pallet load so as to wrap said stretchable membrane about said pallet load between said first and second limits.

11. A pallet wrapping apparatus as claimed in claim 10 wherein said support means is adapted for horizontal securement at said one end to a vertical structure so as to present a cantilevered support beam projecting outwardly from said vertical structure above said pallet load.

12. A pallet wrapping apparatus as claimed in claim 11 whereby said hollow leg means presents slot means along a portion of said hollow leg means and said carriage means includes connecting means received by said slot means for connecting said carriage means to said endless chain link means.

* * * * *